US010655080B2

(12) United States Patent
El Ojaimi et al.

(10) Patent No.: US 10,655,080 B2
(45) Date of Patent: May 19, 2020

(54) CORN SYRUP, AN INVERSION AID FOR WATER-IN-OIL POLYMER EMULSIONS

(71) Applicant: Ecolab USA Inc., St. Paul, MN (US)

(72) Inventors: Maya El Ojaimi, Sugar Land, TX (US); Joseph Paul Street, Friendswood, TX (US); Pious Kurian, Sugar Land, TX (US)

(73) Assignee: Ecolab USA Inc., St. Paul, MN (US)

( * ) Notice: Subject to any disclaimer, the term of this patent is extended or adjusted under 35 U.S.C. 154(b) by 329 days.

(21) Appl. No.: 15/435,414

(22) Filed: Feb. 17, 2017

(65) Prior Publication Data

US 2017/0233674 A1 Aug. 17, 2017

Related U.S. Application Data

(60) Provisional application No. 62/296,452, filed on Feb. 17, 2016.

(51) Int. Cl.
*C10M 145/40* (2006.01)
*C10M 107/42* (2006.01)

(52) U.S. Cl.
CPC ..... *C10M 145/40* (2013.01); *C10M 107/42* (2013.01); *C10M 2209/12* (2013.01); *C10M 2217/0245* (2013.01)

(58) Field of Classification Search
CPC ..... C10M 2209/12; C10M 2217/0245
See application file for complete search history.

(56) References Cited

U.S. PATENT DOCUMENTS

| | | | |
|---|---|---|---|
| 3,254,719 | A | 6/1966 | Root |
| 3,734,873 | A | 5/1973 | Anderson et al. |
| 3,996,180 | A | 12/1976 | Kane |
| 4,523,960 | A | 6/1985 | Otte |
| 6,787,506 | B2 | 9/2004 | Blair et al. |
| 7,429,625 | B2 | 9/2008 | Harrington et al. |
| 7,745,378 | B1 | 6/2010 | Rayborn, Sr. |
| 7,763,570 | B1 | 7/2010 | Rayborn, Sr. et al. |
| 7,928,042 | B2 | 4/2011 | Reed et al. |

FOREIGN PATENT DOCUMENTS

WO 2013/119759 A1 8/2013

OTHER PUBLICATIONS

International Search Report relating to PCT Patent Application No. PCT/US2017/018297 dated May 11, 2017, 4 pages.
Written Opinion relating to PCT Patent Application No. PCT/US2017/018297 dated May 11, 2017, 6 pages.

*Primary Examiner* — Vishal V Vasisth
(74) *Attorney, Agent, or Firm* — Stinson LLP

(57) ABSTRACT

The present invention generally relates to the method of using corn syrup to improve the inversion properties of water-in-oil (w/o) friction reducing polymers.

21 Claims, 1 Drawing Sheet

CORN SYRUP, AN INVERSION AID FOR WATER-IN-OIL POLYMER EMULSIONS

CROSS-REFERENCE TO RELATED APPLICATION

This application claims priority to U.S. Provisional Patent Application Ser. No. 62/296,452 filed on Feb. 17, 2016, the disclosure of which is incorporated herein by reference in its entirety.

FIELD OF THE INVENTION

The present invention generally relates to the method of using corn syrup to improve the inversion properties of water-in-oil (w/o) friction reducing polymers.

BACKGROUND OF THE INVENTION

The term water-in-oil emulsion or inverse emulsion refers to an aqueous phase (discontinuous phase) dispersed in a non-aqueous organic phase (continuous phase). In such emulsions, the active water soluble polymers are coiled inside the discontinuous aqueous phase.

Corn syrup or hydrolyzed glucose syrup or dextrose syrup is made from the starch of maize. Traditionally, it was produced by acid hydrolysis of corn starch with dilute hydrochloric acid then heating the mixture under pressure to break down the starch molecules into sugar. Currently, corn syrup is produced by enzymatic processes.

Corn syrup solids are manufactured by concentrating corn syrup liquid and removing up to 97% of its water.

High fructose corn syrup or HFCS is made from corn syrup through an enzymatic process that converts the dextrose sugar in the corn syrup into fructose sugar. It is sweeter than corn syrup.

Water-soluble polymers such as polyacrylamide and various copolymers have previously been used for many applications within a variety of industries: Mobility control polymers within the oil and gas industry and as flocculants within oil and gas, waste water treatment, food and beverage, papermaking, and mining industries. Further, these polymers have been shown to improve sweep efficiency, within the oil industry, by increasing the viscosity of the aqueous flooding fluid and decrease pumping pressure losses in hydraulic fracturing by reducing friction. These polymers can be prepared as emulsions because handling of these polymers in the dry powdered form can be difficult.

Water-in-oil or inverse emulsions are typically used because of their ease of handling, ability to prepare the polymers at high concentrations, and lower viscosity as compared to solution polymers. When introduced into an aqueous solution, the emulsion must invert quickly and release the polymers into solution allowing them to achieve their optimum performance. Therefore, breaker surfactants or inverters or inverting surfactants have been commonly used to disturb the stable inverse emulsion resulting in an inverted polymer. It is desired that the emulsion inverts rapidly and completely so that the friction-reducing polymers can reduce the frictional losses and reduce the amount of energy required to pump the fluid through the conduit.

Upon inversion of the emulsion, the polymers need to be reorganized, and hydrated in order to act as flocculants or friction reducers. Additionally, problems can occur when the aqueous fluid to which the polymer is added contains high salinity. The high salinity can hinder the inversion and hydration process.

Therefore, a need exits to develop methods to quickly invert inverse emulsion polymers thereby exposing the active polymers to achieve their optimum performance especially in high salinity environments.

SUMMARY OF THE INVENTION

One aspect of the invention is a method of inverting a water-in-oil emulsion comprising contacting an aqueous fluid with a water-in-oil emulsion comprising a polymer and corn syrup, whereby the water-in-oil emulsion inverts and releases the polymer.

Another aspect of the invention is a method of inverting a water-in-oil emulsion comprising injecting a water-in-oil emulsion comprising a polymer and corn syrup into an aqueous fluid, whereby the water-in-oil emulsion inverts and releases the polymer.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
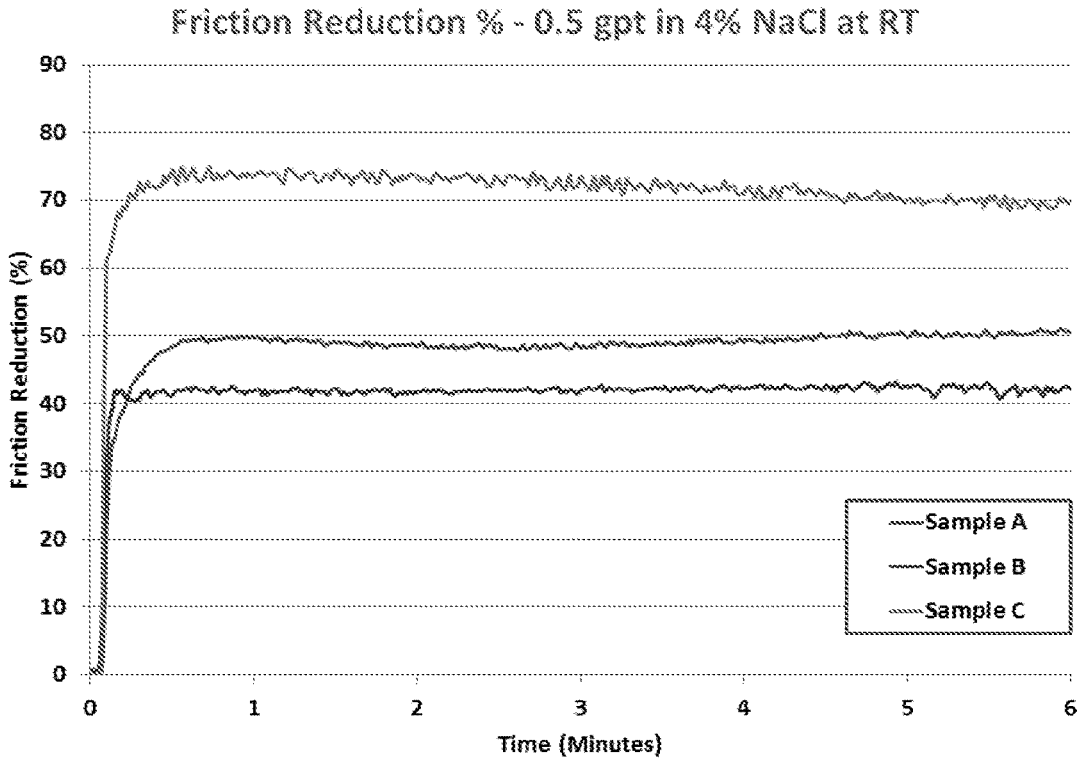
FIG. 1 is a graph of friction reduction (%) using an anionic polymer (FR-1) with various additives.

The methods of the present invention are directed to using an additive that has an advantageous pour point, a low bulk viscosity that allows it to be pumped, and provides reduction in the friction of the fluid flowing in a conduit. There are several potential additives that have one or more of these properties and it has been discovered that corn syrup has an advantageous combination of pour point, bulk viscosity, and friction or drag reduction performance in a conduit to be used for this purpose. The corn syrup is particularly advantageous when the polymer is hydrated in brine solutions with divalent cations such as calcium, magnesium, and barium. The present invention is directed towards a method of inverting a water-in-oil emulsion comprising contacting an aqueous liquid with water-in-oil emulsion. The water-in-oil emulsion comprises a polymer and corn syrup, and the water-in-oil emulsion inverts and thereby releases the polymer into the aqueous liquid.

The methods described herein can reduce the friction pressure from the turbulent flow of an aqueous liquid flowing in a conduit or pipe.

The water-in-oil emulsion can further comprise a surfactant, a stabilizer, or a combination thereof.

The additive can be corn syrup, glycerol, sorbitol, ethoxylated glycerin, polyglycerin, glycolic acid, lactic acid, choline chloride, gluconic acid, sodium gluconate, ethylene glycol, propylene glycol, or a combination thereof. The additive can be corn syrup, glycerol, or a combination thereof. Preferably, the additive is corn syrup.

The additive (e.g., corn syrup) can be added to the water-in-oil emulsion at a concentration from about 1 wt. % to about 40 wt. %, from about 1 wt. % to about 35 wt. %, from about 1 wt. % to about 30 wt. %, from about 1 wt. % to about 25 wt. %, from about 1 wt. % to about 20 wt. %, from about 2.5 wt. % to about 40 wt. %, from about 2.5 wt. % to about 30 wt. %, from about 2.5 wt. % to about 20 wt.

%, from about 2.5 wt. % to about 15 wt. %, from about 5 wt. % to about 40 wt. %, from about 5 wt. % to about 30 wt. %, from about 5 wt. % to about 20 wt. %, or from about 5 wt. % to about 15 wt. %.

The aqueous liquid can comprise a high salinity brine, water, purified water, produced water, or a combination thereof.

The high salinity brine can have a salinity of up to 300,000 mg/L of total dissolved solids (TDS).

The polymer can be derived from an anionic monomer, a cationic monomer, a nonionic monomer, or a combination thereof.

The anionic monomer can comprise acrylic acid, methacrylic acid, maleic acid, itaconic acid, 2-propenoic acid, 2-methyl-2-propenoic acid, 2-acrylamido-2-methyl propane sulfonic acid, sulfopropyl acrylic acid, sulphomethylated acrylamide, allyl sulphonic acid, vinyl sulphonic acid, a quaternary salt of acrylic acid, a quaternary salt of methacrylic acid, acrylamidoglycolic acid, -allyloxy-2-hydroxy-1-propanesulfonic acid, dialkyl aminoethyl acrylate, styrene sulfonic acid, 2-acrylamido-2-methylpropane phosphonic acid, an acid or salt of these monomers, or a combination of these monomers.

Preferably, the anionic monomer can comprise acrylic acid or salt thereof, methacrylic acid or salt thereof, 2-acrylamido-2-methylpropane sulfonic acid or salt thereof, dialkyl aminoethyl acrylate, or a combination thereof.

The cationic monomer can comprise a salt or a quaternary salt of a dialkylaminoalkyl acrylate, a salt or a quaternary salt of a dialkylaminoalkyl methacrylate, a salt or a quaternary salt of a dialkylaminoalkylacrylamide, a salt or a quaternary salt of a dialkylaminoalkylmethacrylamide, a N,N-diallyldialkyl ammonium halide, or a combination thereof.

Preferably, the cationic monomer can comprise dimethylaminoethylacrylate methyl chloride quaternary salt (DMAEA.MCQ), dimethylaminoethylmethacrylate methyl chloride quaternary salt (DMAEM.MCQ), dimethylaminoethylacrylate hydrochloric acid salt, dimethylaminoethylacrylate sulfuric acid salt, dimethylaminoethyl acrylate benzyl chloride quaternary salt (DMAEA.BCQ) dimethylaminoethylacrylate methyl sulfate quaternary salt, dimethylaminopropyl acrylamide hydrochloric acid salt, dimethylaminopropyl acrylamide sulfuric acid salt, dimethylaminopropyl methacrylamide hydrochloric acid salt, dimethylaminopropyl methacrylamide sulfuric acid salt, methacrylamidopropyl trimethyl ammonium chloride, acrylamidopropyl trimethyl ammonium chloride, diallyldimethyl ammonium chloride (DAD MAC), or a combination thereof.

More preferably, the cationic monomer can comprise dimethyl-aminoethyl-acrylate methyl chloride quaternary salt (DMAEA-MCQ), dimethyl-aminoethyl-methacrylate methyl chloride quaternary salt (DMAEM-MCQ), diallyl-dimethyl-ammonium chloride (DADMAC), or a combination thereof.

The nonionic monomer can comprise N-isopropylacrylamide, N,N-dimethylacrylamide, N,N-diethylacrylamide, dimethylaminopropyl acrylamide, dimethylaminopropyl methacrylamide, acryloylmorpholine, hydroxyethyl acrylate, hydroxypropyl acrylate, hydroxyethyl methacrylate, hydroxypropyl methacrylate, dimethylaminoethylacrylate (DMAEA), dimethylaminoethyl methacrylate (DMAEM), maleic anhydride, N-vinyl pyrrolidone, vinyl acetate, N-vinyl formamide, acrylamide, methacrylamide, N-methylacrylamide, methyl acrylate, methyl methacrylate, acrylonitrile, N-vinyl methylformamide, acrolein, N,N-diallylamine, or a combination thereof.

Preferably, the nonionic monomer can comprise acrylamide, methacrylamide, or a combination thereof.

The inverse emulsion polymer can have a weight-average molecular weight from about 100,000 Daltons to about 50,000,000 Daltons, from about 100,000 Daltons to about 40,000,000 Daltons, from about 100,000 Daltons to about 30,000,000 Daltons, from about 100,000 Daltons to about 20,000,000 Daltons, from about 100,000 Daltons to about 10,000,000 Daltons. Preferably, the weight-average molecular weight is from about 100,000 Daltons to about 5,000,000 Daltons.

The inverse polymer emulsion can be prepared by a radical polymerization process. Preferably, the inverse emulsion polymer particle is prepared by an emulsion polymerization process.

In particular, inverse polymer emulsion can be prepared by emulsification of a water-soluble monomer in the oil phase, with subsequent polymerization, a process called inverse emulsion polymerization. In an inverse emulsion polymerization, a hydrophilic monomer or blend of monomers, frequently in aqueous solution, is emulsified in a continuous oil phase using water-in-oil emulsifiers and polymerized using either oil-soluble or water-soluble initiators. A water-in-oil emulsion results, typically a viscous liquid formed from submicroscopic, water-containing, hydrophilic polymer particles suspended in the continuous oil phase.

The surfactant can comprise a nonionic alcohol ethoxylate, a polymeric surfactant, an ionic surfactant, or a combination thereof. The surfactant can comprises an alcohol ethoxylate, a quaternary ammonium salt, an anionic surfactant sulfate, an anionic surfactant sulfonate, a zwitterionic surfactant comprising a quaternary ammonium cation and a carboxylate (betaine), or a combination thereof. Preferably, the surfactant can comprise an alcohol ethoxylate.

The stabilizer can comprise ammonium or sodium thiosulfate, ammonium or sodium thiocyanate, sodium metabisulfite, or a combination thereof.

The amount of sodium acrylate repeat units incorporated into the polymer can be from about 1 mole % to about 40 mole %, from about 5 mole % to about 40 mole %, from about 10 mole % to about 40 mole %, from about 15 mole % to about 40 mole %, from about 20 mole % to about 40 mole %, from about 5 mole % to about 30 mole %, from about 10 mole % to about 30 mole %, from about 15 mole % to about 30 mole %, from about 20 mole % to about 30 mole %, or from about 22 mole % to about 30 mole %.

The polymer can be derived from acrylamide and dimethyl-aminoethyl-methacrylate methyl chloride quaternary salt (DMAEM-MCQ) monomers.

The amount of dimethyl-aminoethyl-methacrylate methyl chloride quaternary salt (DMAEM-MCQ) repeat units incorporated into the polymer can be from about 0.5 mole % about to about 30 mole %, from about 0.5 mole % about to about 25 mole %, from about 0.5 mole % about to about 20 mole %, from about 0.5 mole % about to about 15 mole %, from about 1 mole % about to about 30 mole %, from about 1 mole % about to about 25 mole %, from about 1 mole % about to about 20 mole %, from about 1 mole % about to about 15 mole %, or from about 1 mole % to about 10 mole %.

The water-in-oil emulsion can be contacted to an aqueous liquid at a concentration from about 0.1 gallons per thousand gallons (gpt) to about 8 gpt, from about 0.1 gallons per thousand gallons (gpt) to about 6 gpt, from about 0.1 gallons per thousand gallons (gpt) to about 4 gpt, from about 0.1 gallons per thousand gallons (gpt) to about 2 gpt, from about 0.5 gallons per thousand gallons (gpt) to about 8 gpt, from about 0.5 gallons per thousand gallons (gpt) to about 6 gpt, from about 0.5 gallons per thousand gallons (gpt) to about 4 gpt, or from about 0.5 gpt to about 2 gpt.

Unless otherwise indicated, corn syrup can also be referred to as glucose syrup, dextrose syrup, high fructose corn syrup, or a syrup comprising glucose and fructose.

These corn syrups are available as Karo syrup, Karo light corn syrup, Karo dark corn syrup, or Log Cabin® corn syrup.

The syrup can also be derived from other natural and process stages types of sugars. Cane syrup, maple syrup, sugar beet syrup, fruit syrup, coconut syrup, date syrup, agave syrup, palm syrup, rice syrup, chocolate syrup, vanilla syrup, rice syrup, honey, sorghum syrup and molasses and mixtures and blends thereof may be used in this invention.

Having described the invention in detail, it will be apparent that modifications and variations are possible without departing from the scope of the invention defined in the appended claims.

EXAMPLES

The following non-limiting examples are provided to further illustrate the present invention.

The following tests were conducted using formulations of anionic, cationic, and nonionic monomers, and various blends. The anionic polymer used consisted of acrylamide and sodium acrylate monomers; with the polymer containing 22 mole % sodium acrylate groups (the polymer is identified hereinafter as FR-1). The cationic polymer used consisted of acrylamide and dimethyl-aminoethyl-acrylate methyl chloride quaternary salt (DMAEA-MCQ) monomers; with the polymer containing 3 mole % DMAEA-MCQ groups (the polymer is identified hereinafter as FR-2). The inverting surfactant used is an ethoxylated alcohol blend of $C_{11}$-$C_{14}$ isoalkanes. The stabilizer used was ammonium thiosulfate (60 wt. % water). The additive was either water or corn syrup. Formulations are listed in Tables 1 and 2.

Example 1: Preparation of the Anionic Polymer FR-1

The anionic polymer FR-1 was prepared was as follows: the aqueous phase was prepared by combining an acrylamide solution (39.1 g, 49.5% in water), acrylic acid (5.1 g), ethylenediaminetetraacetic acid tetrasodium salt (0.009 g), sodium formate (0.002 g), sodium chloride (2.0 g), and DI water (24.4 g). The pH was adjusted to a value of 7.5 using sodium hydroxide (50% solution).

In a separate container, an oil phase was prepared by combining paraffin oil (22.9 g), SPAN 80 (1.1 g), and TWEEN 81 (0.8 g). The oil phase was transferred to a glass reactor equipped with a mechanical stirrer, a nitrogen sparger, and a thermometer.

The aqueous phase was added to the reactor while stirring at 1000 rpm. The mixture was purged with nitrogen for 30 minutes. Redox initiators comprising tert-butyl hydroperoxide (70% solution, 0.0098 g in 0.130 g DI water) and anhydrous sodium metabisulfite (0.0134 g in 0.130 g DI water) were added to the mixture to initiate the reaction. After the reaction peak was reached, the temperature was raised to 70° C. and an additional amount of anhydrous sodium metabisulfite (0.01 g) was added to the mixture.

After holding the temperature at 70° C. for an hour, the mixture was cooled to room temperature and filtered using a 100-mesh screen.

Example 2: Preparation of the Cationic Polymer FR-2

The cationic polymer FR-2 was prepared as follows: the aqueous phase was prepared by combining an acrylamide solution (48.7 g, 49.5% in water), DMAEA.MCQ (2.49 g, 88% in water), ethylenediaminetetraacetic acid tetrasodium salt (0.02 g), sodium chloride (2.9 g), adipic acid (1 g) and DI water (14.4 g).

In a separate container, an oil phase was prepared by combining paraffin oil (25.3 g), SPAN 80 (1.16 g), and TWEEN 61 (0.9 g). The oil phase was transferred to a glass reactor equipped with a mechanical stirrer, a nitrogen sparger, and a thermometer.

The aqueous phase was added to the reactor while stirring at 1000 rpm. The mixture was purged with nitrogen for 30 minutes and warmed to 42° C. Initiators comprising 2,2'-azobisisobutyronitrile (0.02 g) and 2,2'-azobis (2,4-dimethyl valeronitrile) (0.003 g in 0.130 g DI water) were added to the mixture to initiate the reaction. The temperature was maintained at 42° C. for 2 hours then the mixture was heated to 70° C. Ammonium persulfate (0.05 g, in 0.26 g DI water) and anhydrous sodium metabisulfite (0.17 g, in 0.32 g DI water) were added and the temperature was held at 70° C. for an hour.

The mixture was cooled to room temperature and filtered using a 100-mesh screen.

Example 3: Preparation of Polymer Blends

The anionic polymers (Tables 1 and 3) were prepared by combining FR-1 (88 wt. %) and an additive (10 wt. %) followed by stirring at 800 rpm at room temperature using an overhead mixer with a cage-type stirring blade. After 30 minutes, an inverting surfactant (2 wt. %) was added, under the same shear, and stirred for an additional 30 minutes. Various additives were tested, including water and corn syrup and are identified as sample B and sample C, respectively (Table 3).

The cationic polymers (Tables 2 and 4) were prepared by combining FR-2 (87.5 wt. %) and a stabilizer (1 wt. %) followed by stirring at 800 rpm shear at room temperature using an overhead mixer with a cage-type stirring blade. After 30 minutes, an additive was added and stirred. After another 30 minutes, an inverting surfactant (1.5 wt. %) was added, under the same shear, and stirred for an additional 30 minutes. Various additives were tested, including water and corn syrup and are identified as samples (sample E and sample F), respectively (Table 4).

TABLE 1

Formulations of the anionic polymers.

| Formulation Composition | Content (wt. %) |
|---|---|
| Anionic polymer | 88 |
| Additive | 10 |
| Inverting surfactant | 2 |

TABLE 2

Formulations of the cationic polymers.

| Formulation Composition | Content (wt. %) |
|---|---|
| Cationic polymer | 87.5 |
| Stabilizer | 1.0 |
| Additive | 10 |
| Inverting surfactant | 1.5 |

Example 4: Bulk Viscosity

Bulk viscosity of the blend (400 mL) was measured using Brookfield D-I prime viscometer by measuring the force required to rotate spindle #62 at a spinning rate of 30 rpms at room temperature. The viscosity results are shown in Tables 3 and 4.

Example 5: Pour Point

Pour point measurements were conducted using a Lawler DR4-20 in accordance with the ASTM D97 method. Briefly, the sample of the blend was cooled at a specified rate and examined at intervals of 3° C. for flow characteristics. The lowest temperature at which movement of the sample was observed is the pour point. The pour point results are shown in Tables 3 and 4.

TABLE 3

Comparison of anionic polymer formulations with various additives.

| Sample ID | Additive | Bulk Viscosity (Cp) | Pour point |
|---|---|---|---|
| Sample A | No additive | 917.8 | −15° C. |
| Sample B | Water | 333.9 | −3° C. |
| Sample C | Corn syrup | 454.9 | −18° C. |

TABLE 4

Comparison of cationic polymer formulations with various additives.

| Sample ID | Additive | Bulk Viscosity (Cp) | Pour point |
|---|---|---|---|
| Sample D | No additive | 294.9 | −9° C. |
| Sample E | Water | 457.9 | 3° C. |
| Sample F | Corn syrup | 452.9 | −15° C. |

Example 6: Flow Loop

The invertability and performance of the polymers were evaluated using a flow loop apparatus. Flow loop experiments were conducted by charging the apparatus' blend tank with five gallons of tap water or specific brine solution. The fluid was first circulated through the loop at room temperature, while the baseline pressure differential was established. The inverse emulsion polymer (0.5 gallons per thousand gallons fluid) was then added to the blending tank at time zero (0 min, $t_0$).

Figure 2:
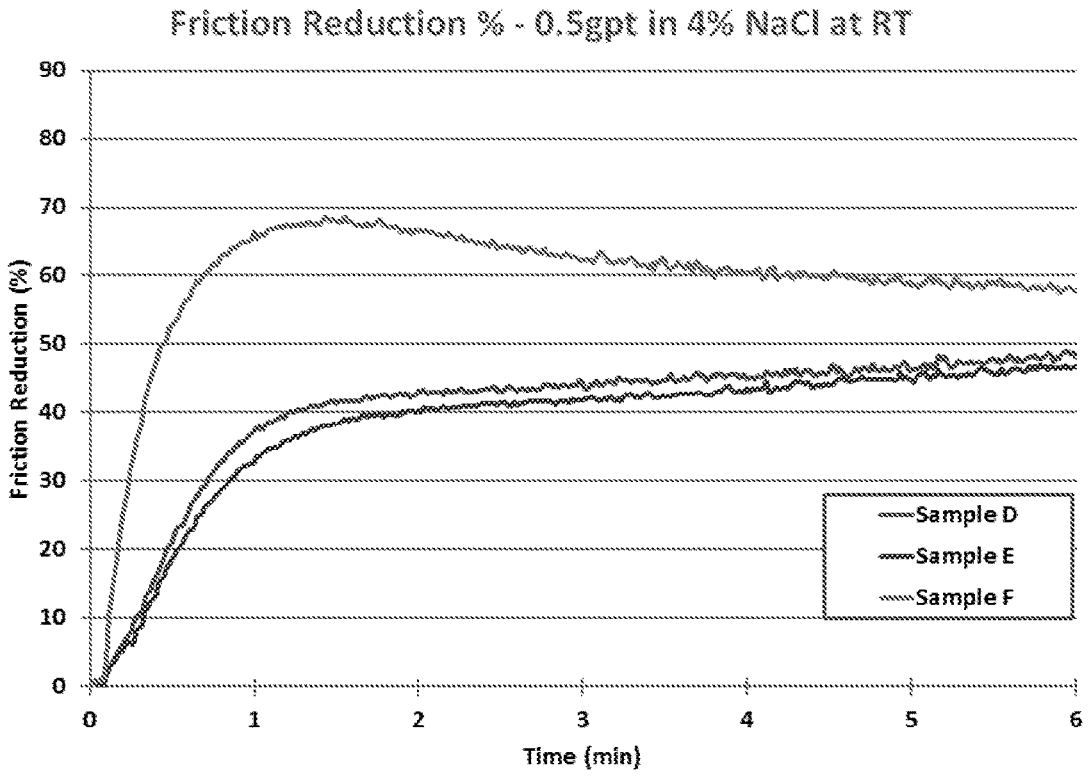
FIG. 2 is a graph of friction reduction (%) using a cationic polymer (FR-2) with various additives.

The tests were conducted on a recirculating flow loop that has test sections through a ⅕ inch pipe with an inner diameter of 0.402 inches. The running flow rate was 8 gallons per minute. The test section has a Reynold's number of 63000. The pressure drop was measured across a straight 4.83 foot section at one second intervals over the course of six minutes. Results are depicted in FIGS. 1 and 2. Friction reduction is calculated as follows:

$$\% \text{ FR}=100\times(P1-P2)/P1$$

Where P1 is the initial pressure drop and P2 is the pressure drop after the addition of the friction reducers.

The invertability of the friction reducer is measured by the time it takes for the friction reduction reaches 90% of the highest value after the injection of the polymer into the fluid ($t_0$). The shorter the time is, the better the invertability.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and methods without departing from the scope of the invention, it is intended that all matter contained in the above description and shown in the accompanying Figures shall be interpreted as illustrative and not in a limiting sense.

What is claimed is:

1. A method of inverting a water-in-oil emulsion comprising contacting an aqueous liquid with water-in-oil emulsion comprising a polymer and from about 5 wt. % to about 25 wt. % corn syrup, whereby the water-in-oil emulsion inverts and releases the polymer and wherein the aqueous liquid comprises a high salinity brine.

2. The method of claim 1 whereby friction of an aqueous liquid flowing in a pipe is reduced.

3. The method of claim 2, wherein the water-in-oil emulsion further comprises a surfactant, a stabilizer, or a combination thereof.

4. The method of claim 1, wherein the aqueous liquid further comprises purified water, produced water, or a combination thereof.

5. The method of claim 1, wherein the polymer is derived from an anionic monomer, a cationic monomer, a nonionic monomer, or a combination thereof.

6. The method of claim 5, wherein the anionic monomer comprises acrylic acid, methacrylic acid, maleic acid, itaconic acid, 2-propenoic acid, 2-methyl-2-propenoic acid, 2-acrylamido-2-methyl propane sulfonic acid, sulfopropyl acrylic acid, sulphomethylated acrylamide, allyl sulphonic acid, vinyl sulphonic acid, a quaternary salt of acrylic acid, a quaternary salt of methacrylic acid, acrylamidoglycolic acid, -allyloxy-2-hydroxy-1-propanesulfonic acid, dialkyl aminoethyl acrylate, styrene sulfonic acid, 2-acrylamido-2-methylpropane phosphonic acid, an acid or salt of these monomers, or a combination of these monomers.

7. The method of claim 6, wherein the anionic monomer comprises acrylic acid or salt thereof, 2-acrylamido-2-propane sulfonic acid or salt thereof, or a combination thereof.

8. The method of claim 5, wherein the cationic monomer comprises a salt or a quaternary salt of a dialkylaminoalkyl acrylate, a salt or a quaternary salt of a dialkylaminoalkyl methacrylate, a salt or a quaternary salt of a dialkylaminoalkylacrylamide, a salt or a quaternary salt of a dialkylaminoalkylmethacrylamide, a N,N-diallyldialkyl ammonium halide, or a combination thereof.

9. The method of claim 5 wherein the cationic monomer comprises dimethylaminoethylacrylate methyl chloride quaternary salt (DMAEA.MCQ), dimethylaminoethylmethacrylate methyl chloride quaternary salt (DMAEM.MCQ), dimethylaminoethylacrylate hydrochloric acid salt, dimethylaminoethylacrylate sulfuric acid salt, dimethylaminoethyl acrylate benzyl chloride quaternary salt (DMAEA.BCQ) dimethylaminoethylacrylate methyl sulfate quaternary salt, dimethylaminopropyl acrylamide hydrochloric acid salt, dimethylaminopropyl acrylamide sulfuric acid salt, dimethylaminopropyl methacrylamide hydrochloric acid salt, dimethylaminopropyl methacrylamide sulfuric acid salt, methacrylamidopropyl trimethyl ammonium chloride, acrylamidopropyl trimethyl ammonium chloride, diallyldimethyl ammonium chloride (DAD MAC), or a combination thereof.

10. The method of claim 9, wherein the cationic monomer comprises dimethyl-aminoethyl-acrylate methyl chloride quaternary salt (DMAEA-MCQ), dimethyl-aminoethyl-methacrylate methyl chloride quaternary salt (DMAEM-MCQ), diallyl-dimethyl-ammonium chloride (DADMAC), or a combination thereof.

11. The method of claim 5, wherein the nonionic monomer comprises N-isopropylacrylamide, N,N-dimethylacrylamide, N,N-diethylacrylamide, dimethylaminopropyl acrylamide, dimethylaminopropyl methacrylamide, acryloylmorpholine, hydroxyethyl acrylate, hydroxypropyl acrylate, hydroxyethyl methacrylate, hydroxypropyl methacrylate, dimethylaminoethylacrylate (DMAEA), dimethylaminoethyl methacrylate (DMAEM), maleic anhydride, N-vinyl pyrrolidone, vinyl acetate, N-vinyl formamide, acrylamide, methacrylamide, N-methylacrylamide, methyl acrylate, methyl methacrylate, acrylonitrile, N-vinyl methylformamide, acrolein, N,N-diallylamine, or a combination thereof.

12. The method of claim 10, wherein the nonionic monomer comprises acrylamide, methacrylamide, or a combination thereof.

13. The method of claim 3, wherein the surfactant comprises an alcohol ethoxylate, a quaternary ammonium salt, an anionic surfactant sulfate, an anionic surfactant sulfonate, a zwitterionic surfactant comprising a quaternary ammonium cation and a carboxylate (betaine), or a combination thereof.

14. The method of claim 3, wherein the stabilizer comprises sodium thiosulfate, ammonium thiosulfate, sodium thiocyanate, ammonium thiocyanate, sodium metabisulfite, or a combination thereof.

15. The method of claim 1, wherein the polymer is derived from acrylamide and sodium acrylate monomers and the amount of sodium acrylate repeat units incorporated into the polymer is from about 22 mole % to about 30 mole %.

16. The method of claim 1, wherein the polymer is derived from acrylamide and dimethyl-aminoethyl-methacrylate methyl chloride quaternary salt (DMAEM-MCQ) monomers and the amount of dimethyl-aminoethyl-methacrylate methyl chloride quaternary salt (DMAEM-MCQ) repeat units incorporated into the polymer is from about 0.5 mole % about to about 30 mole %.

17. The method of claim 16, wherein the amount of dimethyl-aminoethyl-methacrylate methyl chloride quaternary salt (DMAEM-MCQ) repeat units incorporated into the polymer is from about 1 mole % to about 10 mole %.

18. The method of claim 1, wherein the water-in-oil emulsion is contacted to an aqueous liquid at a concentration from about 0.1 gallons per thousand gallons (gpt) to about 5 gpt.

19. The method of claim 1, wherein the high salinity brine has a salinity of up to 300,000 mg/L of total dissolved solids.

20. The method of claim 19, wherein the salinity of the high salinity brine is from about 4 wt. % to about 30 wt. % dissolved solids.

21. The method of claim 1, wherein the high salinity brine comprises about 4 wt. % of a sodium chloride solution.

* * * * *